US008410390B2

(12) United States Patent
Altpeter et al.

(10) Patent No.: US 8,410,390 B2
(45) Date of Patent: Apr. 2, 2013

(54) GRINDING MACHINE WITH A DEVICE FOR CONDITIONING A GRINDING WHEEL AND A METHOD OF CONDITIONING A GRINDING WHEEL

(75) Inventors: Friedhelm Altpeter, Susten (CH); Walter H. Pfluger, Oberdorf (CH)

(73) Assignee: Agathon AG Maschinenfabrik, Solothurn (CH)

( * ) Notice: Subject to any disclaimer, the term of this patent is extended or adjusted under 35 U.S.C. 154(b) by 1142 days.

(21) Appl. No.: 12/335,183

(22) Filed: Dec. 15, 2008

(65) Prior Publication Data

US 2009/0163121 A1 Jun. 25, 2009

(30) Foreign Application Priority Data

Dec. 19, 2007 (EP) ..... 07123579

(51) Int. Cl.
*B23K 9/00* (2006.01)

(52) U.S. Cl. ..... 219/69.11; 219/69.14; 219/69.1; 219/69.15; 219/69.16; 451/56; 451/72

(58) Field of Classification Search ..... 451/56, 451/72; 219/69.11, 69.14, 69.1, 69.15, 69.16
See application file for complete search history.

(56) References Cited

U.S. PATENT DOCUMENTS

| | | | | |
|---|---|---|---|---|
| 4,710,603 | A | 12/1987 | Obara | |
| 5,086,203 | A * | 2/1992 | Kobayashi et al. | 219/69.12 |
| 5,472,371 | A * | 12/1995 | Yamakura et al. | 451/56 |
| 5,739,497 | A * | 4/1998 | Tanaka | 219/69.14 |
| 6,213,843 | B1 * | 4/2001 | Kramer | 451/5 |
| 6,244,939 | B1 * | 6/2001 | Ohmori et al. | 451/72 |
| 7,118,448 | B2 * | 10/2006 | Yamada | 451/5 |
| 2001/0053661 | A1 * | 12/2001 | Ohmori | 451/56 |
| 2003/0102287 | A1 * | 6/2003 | Katsumata et al. | 219/69.11 |
| 2005/0126004 | A1 * | 6/2005 | Smith et al. | 29/890.142 |
| 2009/0017732 | A1 * | 1/2009 | Curodeau et al. | 451/56 |

FOREIGN PATENT DOCUMENTS

| | | |
|---|---|---|
| DE | 40 33 137 C1 | 11/1991 |
| EP | 1 470 894 A1 | 10/2004 |

* cited by examiner

*Primary Examiner* — M. Alexandra Elve
*Assistant Examiner* — Amit K Singh
(74) *Attorney, Agent, or Firm* — Oblon, Spivak, McClelland, Maier & Neustadt, L.L.P.

(57) ABSTRACT

A grinding machine for grinding a workpiece comprises a machine frame, a bearing device provided on the machine frame and movable along guides, in which a cup-shaped grinding wheel is rotatably drivable about a grinding wheel axis and electrically insulated. The grinding wheel is electrically connected to a generator. The device for profile dressing, sharpening and cleaning the grinding wheel consists of a single cup-shaped electrode, which is drivable about its central axis and is placed on a slide, which allows a working gap to exist between the machining surface of the cup-shaped electrode and the annular abrasive surface. A spark erosion discharge occurs in the gap when a voltage is applied. The grinding wheel can thereby be optimally conditioned by electric discharge machining.

9 Claims, 6 Drawing Sheets

GRINDING MACHINE WITH A DEVICE FOR CONDITIONING A GRINDING WHEEL AND A METHOD OF CONDITIONING A GRINDING WHEEL

CROSS-REFERENCE TO RELATED APPLICATIONS

This application is based on and claims the priority benefit of European Patent Application No. 07123579.0 filed on Dec. 19, 2007, the disclosure of which is incorporated by reference in its entirety.

BACKGROUND OF THE INVENTION

I. Field Of The Invention

The present invention relates to a grinding machine for grinding a workpiece, comprising a machine frame, a bearing device provided on the machine frame and movable along guides, in which bearing device a cup-shaped grinding wheel is borne, drivable in a rotating way about a grinding wheel axis and electrically insulated, which wheel is constructed of electrically conductive material and has a first grinding region with an annular abrasive surface and second grinding regions with abrasive surfaces in the shape of the lateral area, in each case consisting of an electrically conductive bonding material and abrasive grit embedded therein, which grinding wheel is electrically connected to a generator, means for holding the workpiece to be ground, a device for conditioning the grinding wheel with at least one movable electrode, which is likewise connected to the generator, and means for supply of a cooling lubricant to the electrode and to the workpiece.

II. Description Of Related Art

Grinding machines of this type are known. With such grinding machines, indexable inserts, for example, are able to be ground, which procedure has to take place with high precision, for which purpose the grinding wheel must also be kept in optimal condition with respect to precision and sharpness. To ensure this quality of the grinding wheel, the wheel must be prepared and conditioned accordingly. Essentially three steps are hereby carried out, i.e. profile dressing, sharpening and cleaning of the grinding wheel.

The profile dressing operation, by which the grinding wheel is brought into the desired shape, is usually carried out for each new grinding wheel. A profile dressing operation is also carried out when the grinding wheel has been in use for a longer period of time. In a known way, such a profile dressing operation is executed with a silicon carbide wheel that can be brought into contact with the grinding wheel in the grinding machine or with which the grinding wheel in the grinding machine can be brought into contact. Besides grinding wheel material, also silicon carbide from the dressing wheel is thereby also removed. This silicon carbide ends up in the cooling lubricant loop, and must be removed from the coolant lubricant medium as quickly as possible since this material is very aggressive. To do this, suitable and costly apparatus are necessary.

During the step of sharpening a grinding wheel, the bonding material of the abrasive surface is reduced to improve the height of the grinding grains projecting over the bonding material. It is known to carry out the step of sharpening of the grinding wheel for metal-bonded grinding wheels by means of electrochemical methods in which an electrochemical stripping of the conductive bonding material of the abrasive surface of the grinding wheel takes place by means of an electrode and an applied electrolyte. The stripped material must then be filtered, in a complex and time-consuming way, out of the electrolytic medium, acting as cooling lubricant, for which purpose expensive devices are needed.

The cleaning of the grinding wheel, by which the swarf which has been created by the grinding operation and which has accumulated in the irregularities of the abrasive surface, is removed, can be carried out in a known way with a white corundum wheel. It can also be carried out, however, using the previously described electrochemical method, whereby the aforementioned drawbacks arise with both methods.

BRIEF SUMMARY OF THE INVENTION

An object of the present invention is therefore to design a grinding machine for grinding a workpiece in such a way that the profile dressing, the sharpening as well as the cleaning of the grinding wheel can be carried out in a simple way using a single tool, and the cleaning of the cooling lubricant can be accomplished in a simple way.

This object is achieved according to the invention in that the device for profile dressing, sharpening and cleaning is configured as a single tool designed as cup-shaped electrode that is provided with at least one annular machining surface, which cup-shaped electrode is borne on a slide in a way drivable in rotation about its central axis, by means of which slide a working gap existing between the respective machining surface of the cup-shaped electrode and the respective abrasive surface is adjustable, in which gap a spark-erosive discharge occurs with application of a spark voltage by the generator.

By means of this electroerosive discharge in the working gap, the bonding material is eroded, depending upon how wide the working gap is, how great the discharge energy is, and which discharge frequency is used. The grinding wheel can thereby be shaped, sharpened and cleaned, which can be achieved in a very simple way by the single electrode, employed here for this purpose. The sharpening and the cleaning of the grinding wheel can be carried out in a problem-free way during the machining by grinding of a workpiece, the efficiency of the machining operations being optimal, since there is no interruption. Ensured moreover is that the grinding wheel constantly has an optimal abrasive quality. The efficiency will also be thereby increased. The machining of the workpieces is very precise. The material removed by the spark-erosive discharge is carried away by the cooling lubricant conducted into the working gap; a cleaning of this cooling lubricant is possible in a simple way, as is also carried out with corresponding spark erosion machines.

The axis of the cup-shaped electrode is preferably aligned parallel to the grinding wheel axis and perpendicular to the machining surface of the grinding wheel. The machining surface is thereby conditioned in an ideal way, perfectly flat and perpendicular to the rotational axis of the grinding wheel.

The shaft of the cup-shaped electrode is preferably borne in the slide in an electrically insulated way, which slide is held on the bearing device via a linear guide, and is displaceable in a controlled way along the linear guide in direction of the axis. The cup-shaped electrode thereby allows itself in a simple and optimal way to be placed on and taken off the machining surface to be conditioned.

Another advantageous design for the invention consists in that the slide is designed as compound slide rest, so that the electrode is movable substantially axially and radially with respect to the grinding wheel, and the electrode is provided with a further machining surface having substantially the shape of the lateral area. Thus, with this electrode, not only the annular abrasive surface of the cup-shaped grinding wheel, but also an abrasive surface in the shape of the lateral area of this grinding wheel can be correspondingly conditioned, whereby the possible applications for grinding processes are increased.

The electrode's machining surface in the shape of the lateral area is preferably cylindrical, and the two slides, designed as compound slide rest, are pivotable toward one another about an axis situated perpendicular thereto. Thus, with this electrode, an abrasive surface in the shape of the lateral area can also be conditioned when the latter has a so-called clearance angle with respect to the annular abrasive surface.

The electrode's machining surface in the shape of the lateral area can also be designed frustoconical, whereby, by moving both slides at the same time, an abrasive surface in the shape of the lateral area can also be conditioned when the latter has a so-called clearance angle with respect to the annular abrasive surface.

The generator for creating the spark-erosive discharge is a spark generator with capacitive discharge, which makes possible an optimal spark-erosive discharge. It is disposed on the bearing device for the cup-shaped grinding wheel, resulting in the shortest possible discharge lines for the spark-erosive discharge, which has positive consequences for the latter.

The means of supply of the cooling lubricant preferably consist of jet nozzles disposed on the supply lines, via which jet nozzles the cooling lubricant is able to be conducted into the machining gap and to the workpiece, resulting in an optimal conditioning and an optimal cooling and lubrication.

Another preferred embodiment of the invention consists in the cooling lubricant being an oil-based dielectric fluid, whereby an optimal cooling and lubrication during the grinding procedure is achieved, and an optimal environment is obtained for the spark-erosive discharge for conditioning of the grinding wheel.

The electrode is preferably made of aluminum, whereby it can easily be put into shape, and moreover, in combination with the oil-based dielectric fluid, an optimal spark-erosive discharge is achievable.

A control device is preferably provided for control and regulation of the operational procedures, whereby these procedures can be optimally coordinated with the grinding steps to be carried out.

A further object of the invention consists in creating a method for conditioning a cup-shaped grinding wheel by means of which this grinding wheel is optimally shaped, sharpened and cleaned, which object is achieved according to the invention in that to condition the abrasive surfaces of the grinding wheel, a cooling lubricant is conducted into the working gap, a spark voltage is applied over the working gap via the generator, and the electrode is moved toward the grinding wheel at a feed rate until a predetermined threshold value of the average voltage, measured over the working gap, and/or of the average current flow, measured through the discharge lines, is exceeded; then the spark voltage over the working gap, the discharge energy, the discharge frequency and the feed rate are each set to a predetermined value for profile dressing, sharpening or cleaning of the grinding wheel, and the respective step is carried out by spark erosion discharge.

To profile dress the grinding wheel, a discharge energy of about 10 to 100 mJ and a discharge frequency of about 1 to 100 kHz are preferably selected, resulting in an optimal erosion rate.

The profile dressing operation is carried out until the average voltage, measured over the working gap, and/or the average current flow, measured through the discharge lines, is substantially constant, which indicates that the profile-dressed abrasive surface has an optimal shape.

For preliminary sharpening of the grinding wheel, a discharge energy of about 0.1 to 5 mJ and a discharge frequency of about 10 kHz to 1 MHz are selected. A corresponding discharge energy and discharge frequency are also selected for sharpening and cleaning of the grinding wheel, it being possible for the sharpening and cleaning of the grinding wheel to be carried out during the grinding of a workpiece.

After a grinding operation, it can be necessary to re-establish the optimal state of sharpness of the abrasive surface being used by means of an additional re-sharpening operation. This re-sharpening operation lasts a predetermined amount of time during which grinding does not take place, and works with parameters similar to those for the sharpening and cleaning of the grinding wheel during the grinding of a workpiece.

An optimal operation of conditioning of the grinding wheel by the electrode is then achieved when the feed rate of the electrode is set within a selectable range by a regulator, disposed in the control system, based on the average voltage, measured over the working gap, and on the average current flow, measured through the discharge lines.

The discharge energy and the discharge frequency during the sharpening and cleaning of the grinding wheel are preferably set within a selectable range, using an optimization algorithm stored in the control system, based on the maximal contact pressure, the average contact pressure during spark-out, the ratio of the power output of the drive motor to the contact pressure and to the wheel attrition, measured during the preceding and completed grinding operations. The process flow is thereby made easier.

For re-sharpening of the grinding wheel between two grinding operations, a discharge energy of about 0.1 to 5 mJ and a discharge frequency of about 10 kHz to 1 MHz are preferably selected, and this re-sharpening operation is carried out during a selectable re-sharpening time, whereby a high degree of process stability is achieved.

A further simplification of the handling is achieved in that the discharge energy and the discharge frequency during the re-sharpening of the grinding wheel and also the re-sharpening time are set within a selectable range, using an optimization algorithm stored in the control system, based on the maximal contact pressure, the average contact pressure during spark-out, the ratio of the power output of the drive motor to the contact pressure and the wheel attrition, measured during the preceding and completed grinding operations.

An embodiment of the device according to the invention and of the method according to the invention for conditioning a grinding wheel will be explained more closely in the following, by way of example, with reference to the attached drawing:

DETAILED DESCRIPTION OF THE INVENTION

Figure 1:
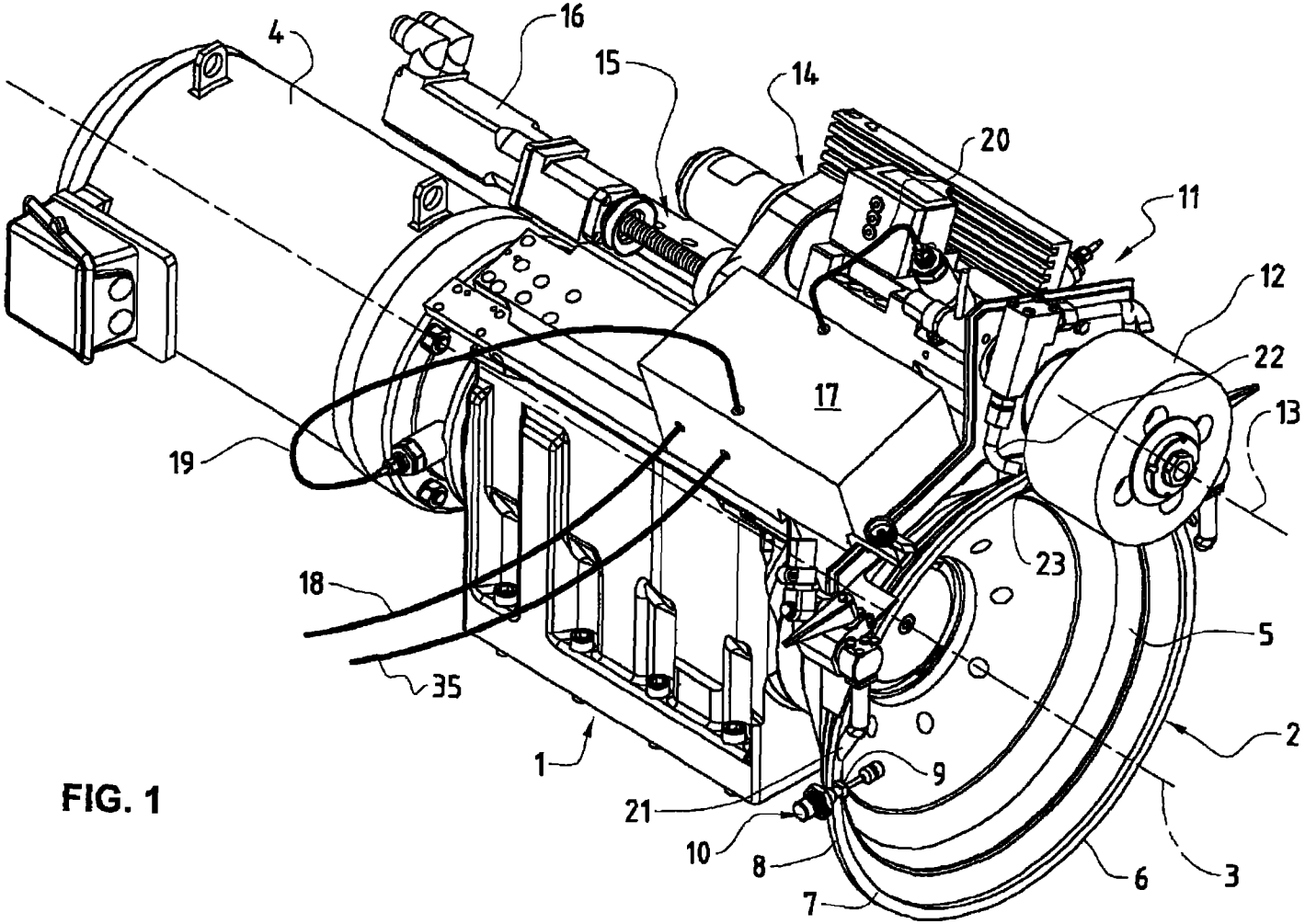
FIG. 1 is a spatial representation of the bearing device for the rotatably drivable, cup-shaped grinding wheel, with the device for profile dressing, sharpening and cleaning of the grinding wheel installed.

In FIG. 1, the bearing device 1 can be seen, which is placed in a known way (not shown) directly on the machine frame of a grinding machine or on a slide configuration inserted between bearing device 1 and machine frame. Borne in this bearing device 1 in a way rotatable about a grinding wheel axis 3 is a cup-shaped grinding wheel 2. The driving in rotation of this grinding wheel 2 takes place by means of an electromotor 4, which is disposed on the bearing device 1.

The cup-shaped grinding wheel 2 consists of a grinding wheel cup 5, on which an abrasive ring 6 is placed having an annular abrasive surface 7 and an abrasive surface 8 in the shape of the lateral area. With this grinding wheel 2, a workpiece 9 can be ground, for example an indexable insert, which is held in a known way via means 10 for holding the workpiece 9 to be ground, disposed in the grinding machine.

Provided for conditioning the abrasive surfaces 7, 8 of the cup-shaped grinding wheel 2 is a device 11 having a cup-shaped electrode 12, borne in a way rotatable about its central axis 13 in a slide 14, which is held on the bearing device 1 in a way displaceable in direction of the central axis 13. The displacement of the slide 14 on the bearing device 1 takes place via a ball screw drive 15, the drive motor 16 of which is mounted on the bearing device 1.

Likewise disposed on the bearing device 1 is a generator 17. This generator 17 is connected to the power supply for the grinding machine via lines 18. The generator 17 is connected to the cup-shaped grinding wheel 2 via a discharge line 19 and to the cup-shaped electrode 12 via a further discharge line 20, as will be seen in the following. The communication with the known machine control system (not shown) takes place via the line 35, which can fulfill the most diverse specifications, such as Ethernet, PROFIBUS or RS 232.

Provided in a known way in the region of the workpiece 9 to be ground is a jet nozzle 21, which is connected to a supply line (not shown), via which a cooling lubricant can be brought into the grinding region. A further jet nozzle 22 is disposed in a known way in the region of the electrode, via which jet nozzle, by means of a supply line (not shown), the cooling lubricant is able to be brought into the working gap 23 between the cup-shaped electrode 12 and the abrasive ring 6 of the grinding wheel 2.

Figure 2:
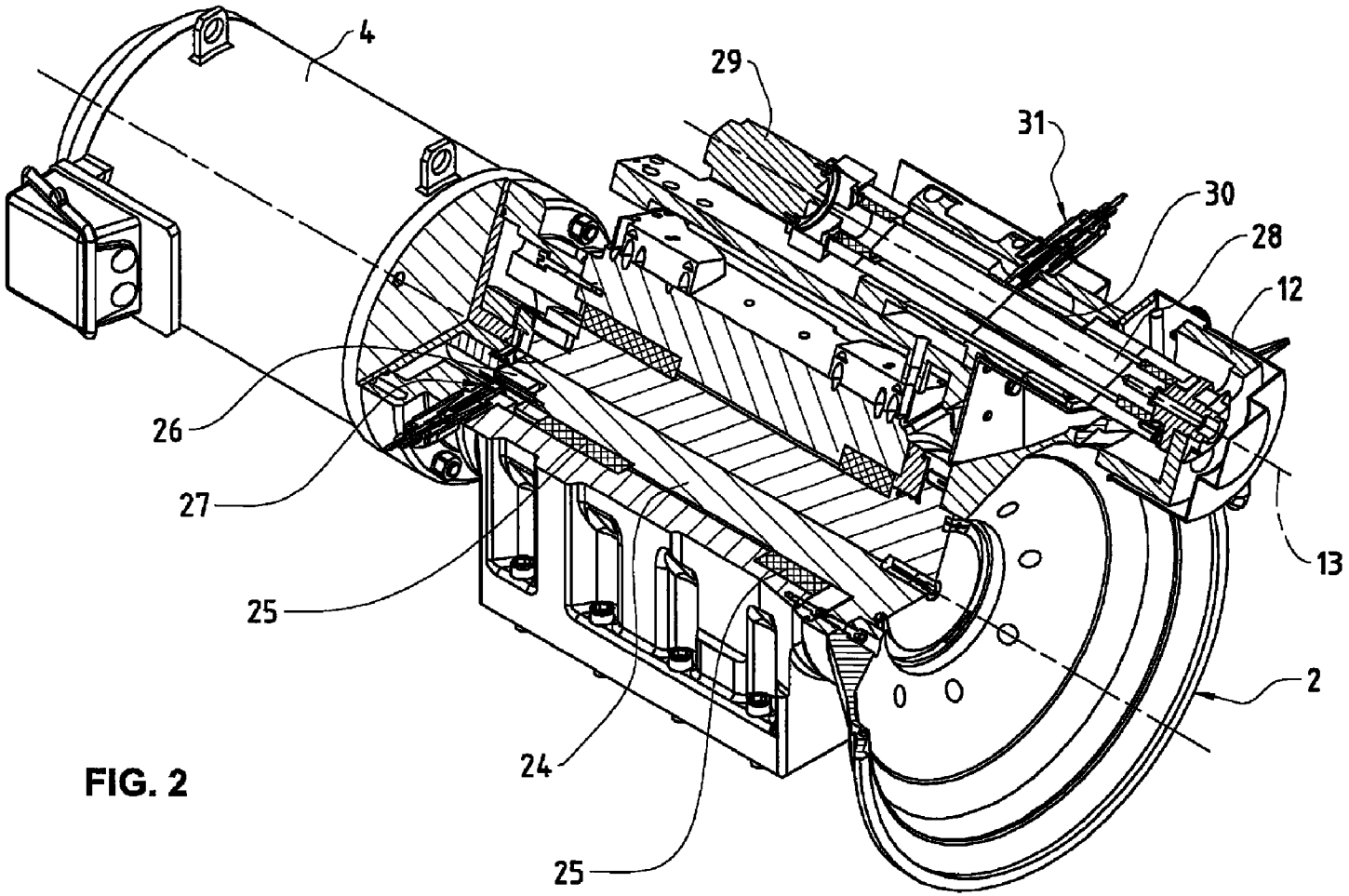
FIG. 2 is a spatial representation of the device according to FIG. 1, in section.

As can be seen from FIG. 2, the spindle 24 of the cup-shaped grinding wheel 2 is borne in electrically insulated bearings 25. The electromotor 4 is electrically insulated with respect to the spindle 24 in a known way. Provided on the spindle 24 is an abrasive ring 26, which co-operates with a contact 27, to which the discharge line 19 (FIG. 1) is connected. The cup-shaped grinding wheel 2 is thereby connected to the generator 17 (FIG. 1) via the spindle 24, the abrasive ring 26, the contact 27 and the corresponding discharge line.

As can also be seen from FIG. 2, the cup-shaped electrode 12 is connected via flange to an electrode spindle 28, which is correspondingly borne in an electrically insulated way in the slide 14 (FIG. 1), and is drivable about the central axis 13, via the motor 29, disposed in a way electrically insulated with respect to the spindle 28. Provided on the electrode spindle 28 is once again an abrasive ring 30, which co-operates with a contact 31, which contact 31 is electrically connected to the generator 17 via the discharge line 20 (FIG. 1).

The grinding wheel cup 5 of the cup-shaped grinding wheel 2 is made of an electrically conductive material. The abrasive ring 6 put on the grinding wheel cup 5 consists of a base body of aluminum, bronze or steel. Provided on this base body are the abrasive surfaces 7, 8 consisting of a compound in which the abrasive grains are embedded. The bonding material is composed of a metal alloy, of synthetic resin or of ceramic, which are likewise able to conduct electricity. Embedded in a known way in this electrically conductive bonding material are the abrasive grains, which can be made of diamond or of another correspondingly suitable material.

The cup-shaped electrode 12 likewise consists of an electrically conductive material, preferably aluminum. This cup-shaped electrode 12 can also be made of copper, graphite or another electrically conductive material, however.

Used as cooling lubricant is preferably an oil-based dielectric fluid, for instance the cooling lubricant marketed under the designation "lonogrind" by the company Oelheld GmbH, Stuttgart, Germany. The generator 17 used here is a spark generator, such as described, for example, in U.S. Pat. No. 4,710,603 of the company Fanuc Ltd.

For conditioning the abrasive surfaces 7, 8 of the cup-shaped grinding wheel 2, a spark voltage is applied by the generator 17 over the working gap 23, whereby an ion channel is formed in the dielectric cooling lubricant between the cup-shaped electrode 12 and the cup-shaped grinding wheel 2, and a discharge occurs. The working gap 23 must be sufficiently large so that the disengaged bonding material as well as the disengaged abrasive grains are able to be flushed away without the cup-shaped electrode 12 or the abrasive surfaces 7, 8 of the cup-shaped grinding wheel 2 being damaged. For a metal-bonded diamond grinding wheel with 25 micrometer grit, the working gap 23, i.e. the spacing between the bottom of the bonding material of the abrasive surface of the grinding wheel 2 and the cup-shaped electrode 12 should measure between 50 and 100 micrometers. To be able to achieve this, a spark voltage over the working gap 23 is required of 300 to 500 volts, preferably 400 volts. With lesser spark voltage there is the risk that the working gap is too small, and the disengagement of the bonding material and of the abrasive grains damages the surface of the cup-shaped electrode 12.

As has already been mentioned, the generator 17 is disposed on the bearing device 1, which means that the electrical discharge lines 19 and 20 (FIG. 1) are able to be kept very short, whereby an optimal conditioning process for the grinding wheel by means of electrical discharge machining is able to be achieved.

Figure 3:
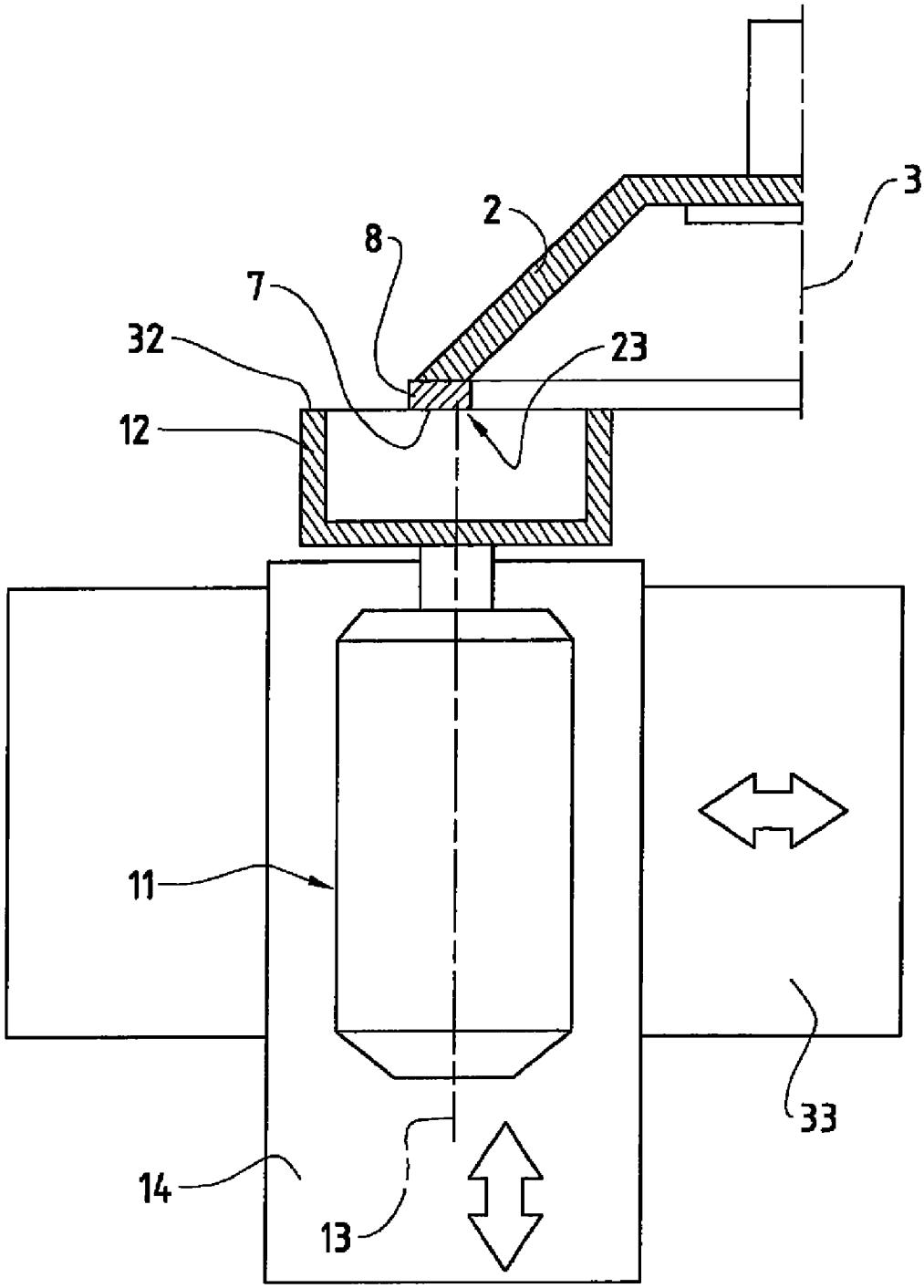
FIG. 3 shows in a diagrammatic representation the device for conditioning the cup-shaped grinding wheel, shown in a first position for conditioning the annular abrasive surface of the grinding wheel.

FIG. 3 shows, in a diagrammatic representation, the positioning of the cup-shaped electrode 12 to the cup-shaped grinding wheel 2 when the annular abrasive surface 7 of the cup-shaped grinding wheel 2 is supposed to be conditioned. The central axis 13 of the cup-shaped electrode 12 is hereby aligned exactly parallel to the grinding wheel axis 3. The cup-shaped electrode 12 is designed to be of hollow cylindrical shape, and has an annular machining surface 32 which is precisely flat. The cup-shaped grinding wheel 2 rotates about the grinding wheel axis 3, the circumferential velocity of the grinding wheel being about 15 to 25 meters per second, when a metal-bonded diamond grinding wheel is involved. This can be increased up to 63 meters per second for grinding wheels with CBN grains.

This also corresponds to the speed of the grinding wheel for grinding a workpiece. The cup-shaped electrode rotates about the central axis 13 at a lower speed. Through the rotation of the electrode 12, a very precise evenness of the electrode 12 and of the abrasive surface 7 is achieved.

Before the conditioning step with spark-erosive discharge may be carried out, the cup-shaped electrode 12 must be brought into the correctly spaced-apart position with respect to the abrasive surfaces 7, 8 to be conditioned. The conditioning steps described in the following are carried out with a cup-shaped grinding wheel having a diameter of 400 mm, a surface cover layer of 10 mm and a granularity of 25 micrometers. The discharge energy at the generator is set; the cup-shaped electrode 12 is moved along the central axis 13 towards the grinding wheel 2 via the slide 14, whereby the speed can amount to 10 to 100 micrometers per minute. As soon as the average voltage over the working gap 23, which is measured in a known way, and/or the average current flowing through the electrical discharge lines 19 and 20 (FIG. 1), which is also measured in a known way, exceed a predetermined threshold value, the conditioning by spark-erosive discharge can begin. To profile dress the annular abrasive surface 7, a high discharge energy, typically 10 to 100 mJ, and a minimal discharge frequency, typically 1 to 100 kHz, are selected. The feed rate of the cup-shaped electrode 12 is set at a speed of typically 0.5 to 5 micrometers per minute. This feed rate is regulated during the electric discharge machining within a predetermined range based on the measured average voltage over the working gap 23 and the average current flowing through the two discharge lines.

The profile dressing operation is then ended when the average voltage over the working gap and/or the average current flowing through the discharge lines remains substantially constant, i.e. does not vary more than 10% during a revolution of the grinding wheel 2 or respectively of the electrode 12. With this profile dressing operation, an absolutely flat annular abrasive surface 7 is obtained, which lies in a plane perpendicular to the grinding wheel axis 3. It would also be conceivable to chamfer the annular machining surface 32 of the electrode in a beveled way and not to align the central axis 13 parallel to the grinding wheel axis 3; one would then obtain an annular abrasive surface 7 which would be at an angle with respect to the plane situated perpendicular to the grinding wheel axis 3.

The profile dressing operation can be shortened in that the grinding wheel 2 with the corresponding abrasive surface 7, 8 and the electrode 12 with the corresponding surface abut; the generator 17 remains switched off. The grinding wheel 2 and the electrode 12 are driven in a rotating way. The grinding wheel 2, which is usually delivered in a relatively precisely profiled state, thereby dresses the electrode 12 through a grinding operation. The profile dressing operation can then be brought to an end through the previously described dressing procedure.

With this dressing procedure there is the risk that the electrode is ground unnecessarily too intensely. To prevent this, the generator 17 can be switched on for carrying out the dressing procedure. A medium-sized voltage is applied. Then grinding wheel 2 and electrode 12 are driven toward each other until grinding wheel 2 and electrode 12 abut one another. A short circuit voltage results. The feed motion of the grinding wheel 2 or respectively of the electrode 12 is stopped. One can wait until an equilibrium is reached with respect to the spark-erosive discharge.

For preliminary sharpening of the annular abrasive surface 7 of the cup-shaped grinding wheel 2, a discharge energy of typically 0.1 to 5 mJ and a discharge frequency of typically 10 kHz to 1 MHz are selected. The feed motion of the cup-shaped electrode 12 is brought to a low speed of typically 0.1 to 0.4 micrometers per minute. The feed rate is optimally set within a certain range based on the measured average voltage over the working gap 23 and the average current flowing through the discharge lines, by means of a regulator in the control system. The preliminary sharpening operation can be considered ended when a feed distance is reached of 20 to 50 micrometers, this feed distance corresponding approximately to the grain diameter. Thermally stressed grains are thereby eliminated.

For sharpening and cleaning of the annular abrasive surface 7 of the cup-shaped grinding wheel 2 during the grinding operation (inprocess), the feed motion of the cup-shaped electrode 12 is set at a speed of maximally 0.4 micrometers per minute. Selected thereby are typically discharge energies of 0.1 to 5 mJ and discharge frequencies of 10 kHz to 1 MHz. By means of a regulator in the control system, the feed rate is optimally set within a particular range, based on the measured average voltage over the working gap 23 and the average current flowing through the discharge lines.

During the grinding of a workpiece 9, the contact pressure with which the workpiece 9 is pressed against the grinding wheel 2, and the output of the electromotor 4 for the grinding wheel can be measured in a known way. Calculated in particular are the maximal contact pressure, the average contact pressure during spark out and the ratio of the output of the electromotor to the contact pressure. At the end of each grinding operation, the wheel attrition is estimated in a known way. From these measurement values, or respectively from the data correspondingly processed in a computer and regulator device, the state of sharpness of the abrasive surfaces 7, 8 in use of the grinding wheel 2 allow themselves to be quantified in a known way.

The discharge energy and discharge frequency for sharpening and cleaning are preferably set within a certain range based on the state of sharpness of the abrasive surfaces 7, 8 of the grinding wheel 2 in use during the preceding and completed grinding operations.

To re-sharpen the annular abrasive surface 7 of the cup-shaped grinding wheel 2 between two grinding operations, the feed movement of the cup-shaped electrode 12 is set at a speed of maximally 0.4 micrometers per minute. Selected thereby are typically discharge energies of 01 to 5 mJ and discharge frequencies of 10 kHz to 1 MHz. By means of the regulator in the control system, the feed rate is optimally set within a certain range based on the measured average voltage over the working gap 23 and the average current flowing through the discharge lines. After a particular re-sharpening time, this procedure can be considered finished.

The discharge energy, the discharge frequency and the re-sharpening time are preferably set within a certain range based on the state of sharpness of the abrasive surface 7, 8 of the grinding wheel 2 in use during the preceding and completed grinding operations.

As already mentioned, the values described in the foregoing apply to the conditioning of a cup-shaped grinding wheel with a diameter of 400 mm and having a cover layer thickness of 10 mm and a granularity of 25 micrometers. With larger cover layer thicknesses, the feed rate must be correspondingly reduced, depending upon the removable volume per unit of time. With different granularity, other feed distances correspondingly apply.

Figure 4:
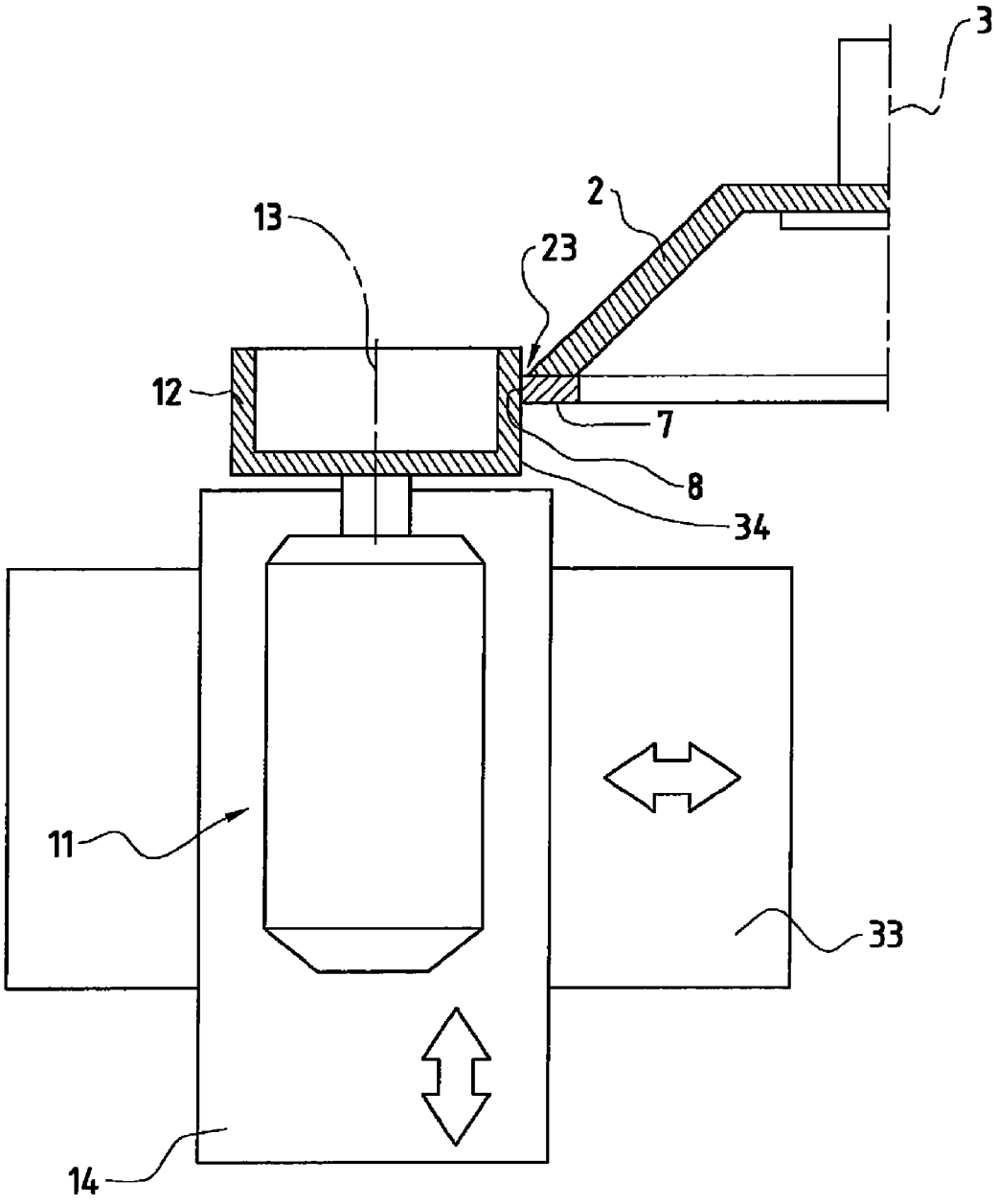
FIG. 4 shows in a diagrammatic representation the device for conditioning the cup-shaped grinding wheel, shown in a second position for conditioning the abrasive surface in the shape of the lateral area, of the grinding wheel.

As can be seen from FIGS. 3 and 4, the slide 14, on which the device for conditioning 11 is disposed, can be placed on a further slide 33 situated perpendicular thereto, so that the cup-shaped electrode 12 can be moved toward the cup-shaped grinding wheel 2 not only in direction of the central axis 13 but also transversely thereto. It can thereby be achieved that an abrasive surface 8 taking the form of the lateral surface of the cup-shaped grinding wheel 2 can also be conditioned with this conditioning device 11.

As can be seen from FIG. 4, the cup-shaped electrode 12 is moved such that its lateral surface 34 is adjacent to the abrasive surface 8 in the shape of the lateral area. The working gap 23 is thus created between abrasive surface 8 in the shape of the lateral area and the lateral surface 34 of the cup-shaped electrode 12. For conditioning this abrasive surface 8 in the shape of the lateral area, the further slide 33 is moved transversely to the central axis 13 of the cup-shaped electrode 12; the cup-shaped electrode 12, however, is also moved in an oscillating way in the direction of the central axis 13 during the conditioning operation, so that the entire lateral surface 34 is evenly stressed.

Figure 5:
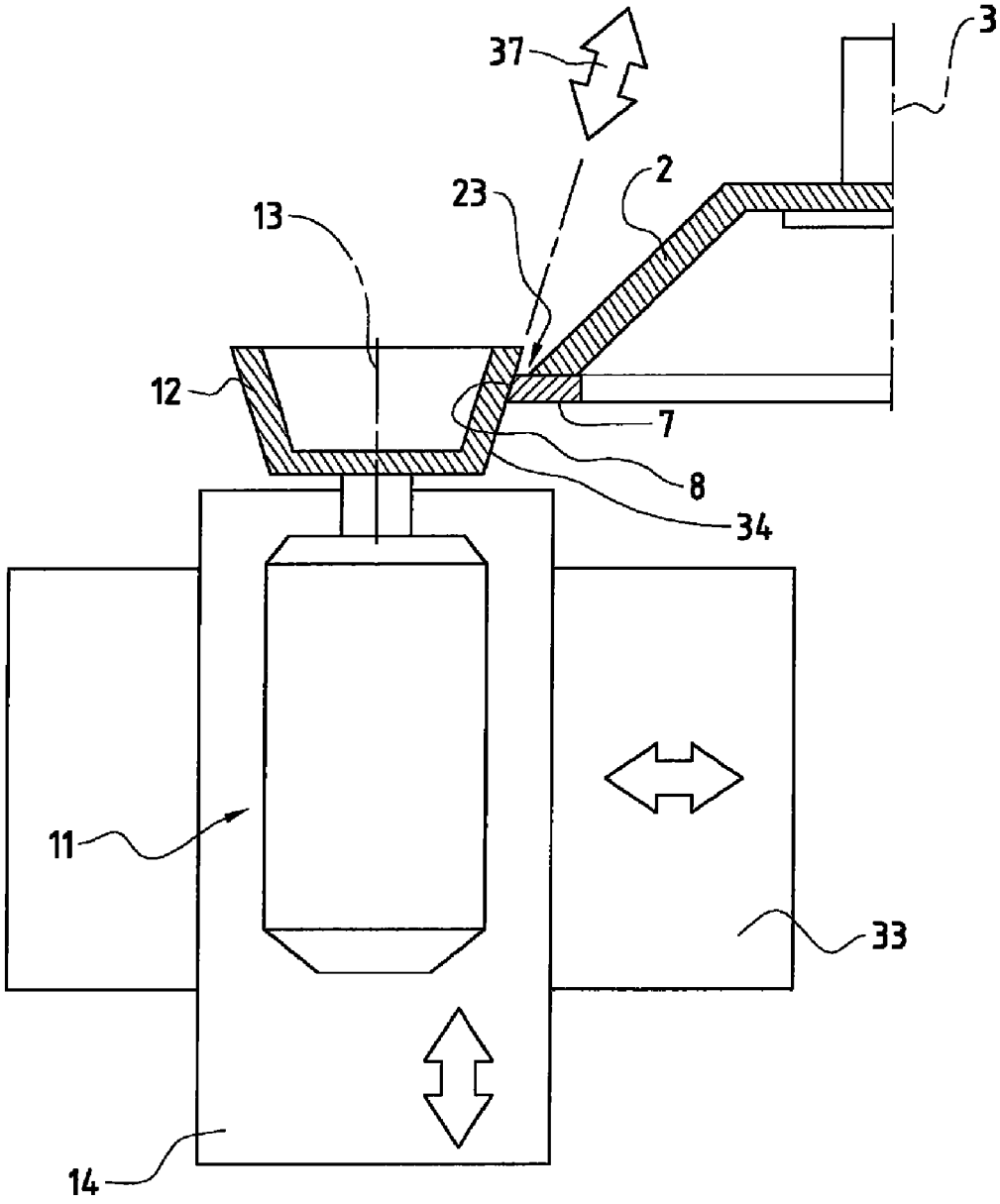
FIG. 5 shows in a diagrammatic representation the device during the conditioning of the abrasive surface in the shape of the lateral areas, of the grinding wheel, the cup-shaped electrode having a frustoconical outer surface, and the abrasive surface with the shape of the lateral area being provided with a clearance angle.

As can be seen from FIG. 5, the cup-shaped electrode 12, which is used in the device 11 for conditioning the abrasive surfaces 7, 8 of the cup-shaped grinding wheel 2, has the shape here of a frustum. The device 11 is placed on the compound slide rest 14, 33. To condition the abrasive surface 8 in the shape of the lateral area, which has a clearance angle with respect to the annular abrasive surface 7 which corresponds to the frustum angle of the electrode 12, the lateral surface 34 of the cup-shaped electrode 12 is brought, by corresponding movement of the two slides 14 and 33, into the region of the abrasive surface 8 in the shape of the lateral area, until the desired working gap 23 is created. During the conditioning procedure for the cup-shaped grinding wheel's 2 abrasive surface 8 in the shape of the lateral area, the electrode 12 rotates about the axis 13. At the same time the two slides 14, 33 are moved in such a way that the electrode carries out a overlapping movement in the direction of the clearance angle, indicated by arrow 37, and is moved in this direction in an oscillating way, whereby here too the lateral surface 34 of the electrode 12 is evenly stressed.

Figure 6:
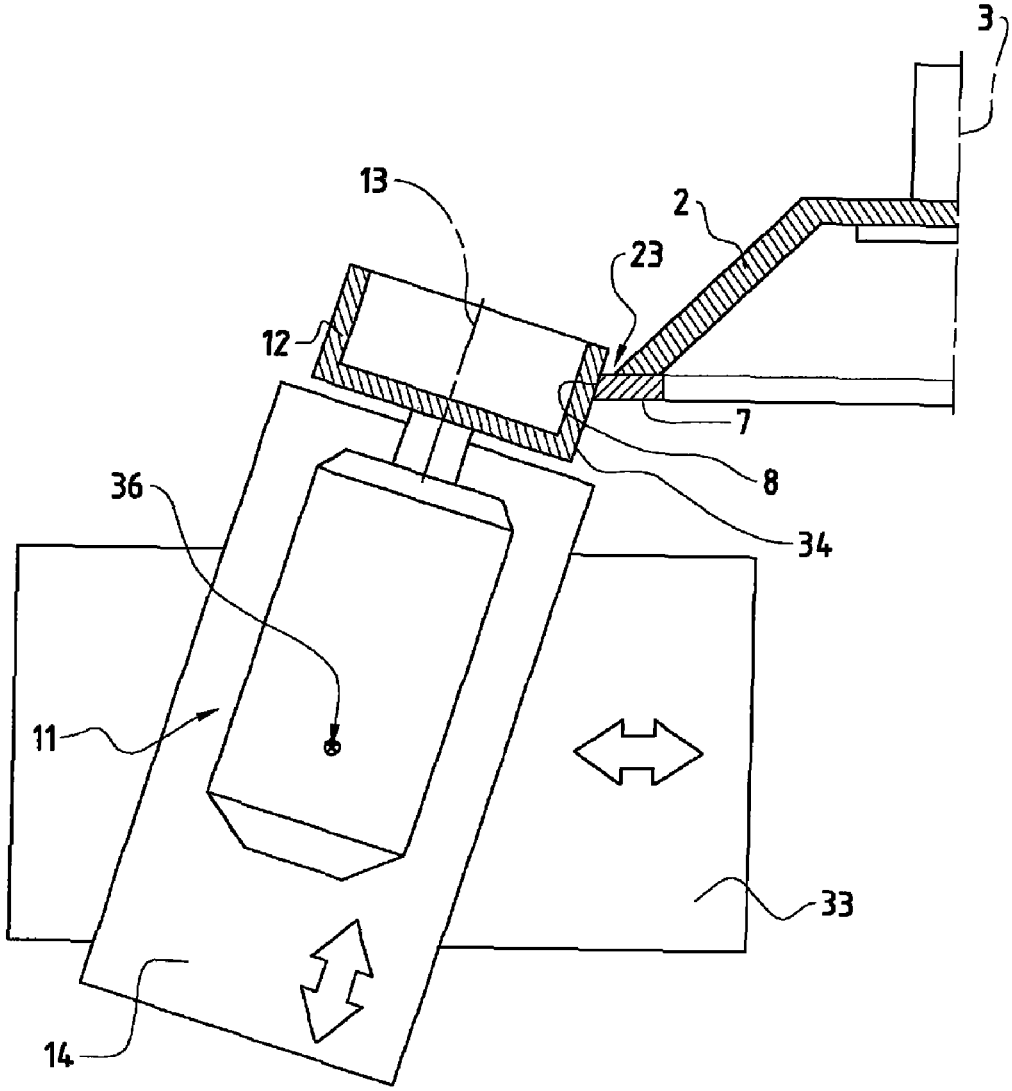
FIG. 6 shows, in a diagrammatic representation, the device during the conditioning of an abrasive surface in the shape of the lateral area and provided with a clearance angle, with cylindrical, cup-shaped electrode.

With the design of the device 11 according to FIG. 6, a lateral-surface-shaped abrasive surface 8 of a cup-shaped grinding wheel 2 that has a clearance angle with respect to the annular abrasive surface 7 can also be conditioned. The cup-shaped electrode 12 used here in the device 11 has a cylindrical outer shape. The slide 14 is pivotable and adjustable in a known way about an axis 36 situated perpendicular to the directions of movement of the two slides 14, 33. To condition the lateral-surface-shaped abrasive surface 8 of the grinding wheel 2, the slide 14 is pivoted with respect to the slide 33 by an angle corresponding to the clearance angle. Through movement of the slide 33, the working gap 23 is adjusted, and the cup-shaped electrode 12 is also moved in the direction of the central axis 13 in an oscillating way during the conditioning operation, so that the entire lateral surface 34 is evenly stressed.

With this device according to the invention and the method according to the invention, a cup-shaped grinding wheel can be conditioned in an optimal way, the sharpening and cleaning operations can be carried out without any problem also during the grinding of workpieces. The grinding wheel always has an optimal state, and the efficiency is thereby increased.

The invention claimed is:

1. A grinding machine for grinding a workpiece, comprising:

a bearing device including a cup-shaped grinding wheel configured to be rotatably drivable about a grinding wheel axis and electrically insulated, wherein the wheel comprises an electrically conductive bonding material embedded with an abrasive grit, is electrically connected to a generator, and has a first grinding region with an annular abrasive surface and second grinding regions with abrasive surfaces in the shape of a lateral area of the wheel;

means for holding a workpiece to be ground; and a device for profile dressing, sharpening and cleaning the abrasive surfaces of the grinding wheel that is electrically connected to the generator and comprises means for supplying a cooling lubricant to an electrode and to the workpiece, wherein the device for profile dressing, sharpening and cleaning is made up of a single tool designed as a cup-shaped electrode provided with at least one annular machining surface, the electrode is configured to be rotatable about a central axis of the cup-shaped electrode on a slide, the slide permits an adjustable working gap to exist between the respective machining surface of the cup-shaped electrode and the respective abrasive surfaces of the grinding wheel, and in the working gap, a spark-erosive discharge occurs with an application of a spark voltage by the generator, and wherein a shaft of the cup-shaped electrode is configured in the slide such that the shaft is electrically insulated, and the slide is displaceably held on the bearing device, in a controlled way, in a direction of the shaft.

2. The grinding machine according to claim 1, wherein a shaft of the cup-shaped electrode is aligned parallel to the grinding wheel axis and orthogonal to the annular machining surface.

3. The grinding machine according to claim 1, wherein the slide is a compound slide rest, so that the electrode is movable substantially axially and radially with respect to the grinding wheel, and the electrode is provided with a further machining surface having substantially a shape of the lateral area of the wheel.

4. The grinding machine according to claim 3, wherein the machining surface of the electrode is cylindrical, and the compound slide rest includes two slides that are pivotable toward one another about an axis situated perpendicular thereto.

5. The grinding machine according to claim 3, wherein the machining surface of the electrode is frustoconical.

6. The grinding machine according to claim 1, wherein the generator is a spark generator with a capacitive discharge, and is disposed on the bearing device.

7. The grinding machine according to claim 1, wherein the means for supplying the cooling lubricant comprise jet nozzles disposed on supply lines that supply the cooling lubricant to be delivered into the working gap and to the workpiece.

8. The grinding machine according to claim 1, wherein the cooling lubricant is an oil-based dielectric fluid.

9. The grinding machine according to claim 1, wherein the electrode is made of aluminum.

* * * * *